US006988958B2

(12) United States Patent
Roelke

(10) Patent No.: US 6,988,958 B2
(45) Date of Patent: Jan. 24, 2006

(54) PUTTER GRIP

(76) Inventor: Harold Roelke, 13050 Gremoor Dr., Elm Grove, WI (US) 53122-1815

( * ) Notice: Subject to any disclaimer, the term of this patent is extended or adjusted under 35 U.S.C. 154(b) by 0 days.

(21) Appl. No.: 10/349,615

(22) Filed: Jan. 23, 2003

(65) Prior Publication Data

US 2003/0109326 A1 Jun. 12, 2003

Related U.S. Application Data

(63) Continuation-in-part of application No. 09/730,307, filed on Dec. 5, 2000, now Pat. No. 6,626,768.

(60) Provisional application No. 60/169,443, filed on Dec. 7, 1999.

(51) Int. Cl.
*A63B 53/16* (2006.01)

(52) U.S. Cl. ..... 473/295; 473/296; 473/297; 473/299; 473/300

(58) Field of Classification Search ..... 473/300–303, 473/201–204, 297, 549–552, 568; 74/551.9; 81/489; 16/421–422; 280/821
See application file for complete search history.

(56) References Cited

U.S. PATENT DOCUMENTS 3,606,326 A * 9/1971 Sparks ..... 473/300
4,365,807 A * 12/1982 Melby ..... 473/295
4,600,195 A * 7/1986 Hunter ..... 473/297
4,746,120 A * 5/1988 Mockovak ..... 473/201
4,878,667 A * 11/1989 Tosti ..... 473/204
4,988,102 A * 1/1991 Reisner ..... 473/297
5,547,189 A * 8/1996 Billings ..... 473/305
5,595,544 A 1/1997 Roelke
5,993,327 A * 11/1999 Terril ..... 473/297
6,623,372 B1 * 9/2003 Beebe et al. ..... 473/231
6,755,096 B2 * 6/2004 Schroder ..... 81/20
2004/0087385 A1 * 5/2004 Murray ..... 473/296

* cited by examiner

*Primary Examiner*—Stephen Blau
(74) *Attorney, Agent, or Firm*—Boyle Fredrickson Newholm Stein & Gratz S.C.

(57) ABSTRACT

An overly wide putter grip includes an elongated body of generally uniform diameter along an axial length thereof and an outer gripping sleeve that fits over the skeleton. The body is a skeleton having a first portion and a second portion. Each of the first and second portions includes an upper end, a lower end opposite the upper end, and a bore disposed within said lower end and extending upwardly so as to be configured to receive a shaft of a putter. The first portion and the second portion of the skeleton are preferably held together by a system of fasteners that go through bores in the first portion of the skeleton and into the second portion to hold the two skeleton portions together. A method of making the putter is also provided.

11 Claims, 5 Drawing Sheets

PUTTER GRIP

CROSS-REFERENCE TO RELATED APPLICATIONS

This application claims priority under 35 U.S.C. §120 as a continuation-in-part to U.S. patent application Ser. No. 09/730,307, filed Dec. 5, 2000, now U.S. Pat. No. 6,626,768, issued Sep. 30, 2003, which claims priority under 35 U.S.C. §119(e) to U.S. Provisional Patent Application No. 60/169,443, filed Dec. 7, 1999, the entireties of both of which are incorporated by reference herein.

BACKGROUND OF THE INVENTION

1. Field of the Invention

The invention relates to golf putter grips, and more particularly, to putter grips designed to inhibit a putter from twisting or turning during the putting stroke or to otherwise improve the ability of a golfer to grip the putter.

2. Discussion of the Related Art

One of the most important, if not the most important, part of any golfer's game is the ability to make putts accurately and with consistency. Indeed, when one considers that putting strokes typically account for one-half or more of a golfer's strokes, the age old expression "drive for show, putt for dough" becomes quite apt. It is therefore of little surprise that golfers and golf equipment manufacturers have devoted a significant amount of time and resources to produce putters which aid golfers in consistently striking the ball on the intended line and with the intended hardness. Most such designs deal with the composition and/or configuration of the putter head. Accordingly, oversized putter heads, specially shaped putter heads, putter heads with arrows and crosses, and putter heads made of brass and other materials designed to improve the "feel" of the putting stroke have all been proposed.

A few attempts have also been made to improve the putting stroke through improved shaft or grip design. Most notably, the so-called "long shaft" putter, having an unusually long shaft, has gained increased acceptance in recent years as a mechanism for improving putting accuracy.

One problem experienced by many golfers, and particularly high-handicappers, is the inability to hit the ball squarely. Even if a golfer having this problem manages to properly initially align the face of the putter with the ball, he or she has a tendency to twist or turn the club face either in or out during the putting stroke, causing the ball to veer away from its intended line after it is struck. This problem is especially evident in so-called mid-range puts in the range of 3–10 feet in which many golfers have a tendency to rush their putt and to look up before they should so that they can follow the path of the ball towards the hole. Mechanism designed to help golfers align the putter with the ball and/or to improve the feel of the putting stroke do little, if anything, to alleviate this problem.

Another problem in previous putter grips is that, given a shaft of a particular, standard length, the "grip height", i.e., the distance from the ground to the top of the grip, is fixed. This is an unattractive feature for tall golfers and those who like to grip at a higher point. For example, some golfers prefer to grip the putter at a higher point and to bend less. The effective lengths standard grips cannot be adjusted to provide different grip height.

An additional problem in previous putter grips is that the grip was not removably affixable to the shaft. A drawback to this is that the grip position can unexpectedly shift. In addition, the rules of the United States Golf Association do not permit adjustment of a grip during a game of golf.

SUMMARY OF THE INVENTION

The invention, which is defined by the claims set out at the end of this disclosure, is intended to solve at least some of the problems noted above. An overly wide putter grip is provided. The putter grip includes an elongated body of generally uniform diameter along an axial length thereof and an outer gripping sleeve that fits over the skeleton. The body is a skeleton having a first portion and a second portion. Each of the first and second portions includes an upper end and a lower end opposite the upper end. A bore is disposed within the lower end and extends upwardly so as to be configured to receive a shaft of a putter.

The first portion and the second portion of the skeleton are preferably held together by a system of fasteners that go through bores in the first portion of the skeleton and into the second portion to hold the two skeleton portions together.

The outer gripping sleeve that fits over the skeleton has an outer peripheral surface that includes a first surface portion that is partially cylindrical in shape and a second surface portion that is at least generally flat and that is continuous with the first surface portion.

The grip is configured to form a step with the shaft. The step is dimensioned and configured to receive two fingers of a golfer on opposite sides of the shaft. The grip is configured and dimensioned to be removably affixed to the shaft by fasteners.

The grip may be provided with an optional extender tube that includes an upper portion that fills a gap between an upper end of the bore in the body and the shaft.

In addition, a putter is provided comprising a head, a shaft, and a grip. The head has a heel, a toe, and a striking face. The shaft has a lower end attached to the head between the heel and the toe thereof and has an upper end located above the lower end.

Also provided is a putter grip that includes an elongated tubular grip having an upper end, a lower end, an outer peripheral gripping surface, and a bore extending from the lower end toward the upper end. The bore is dimensioned and configured to permit the grip to be mounted on an end of a putter shaft. The putter grip also includes a plurality of fasteners which can be accessed from the gripping surface to affix the grip to the shaft. The fasteners preferably are setscrews accessible through recesses in the gripping surface. The setscrews preferably are pointed so as to at least dimple the shaft upon being tightened against the shaft.

In a preferred embodiment, the putter grip includes a segmented skeleton that has at least first and second portions that are fastened to one another by removable fasteners. The putter grip also includes a gripping portion that is mounted over the skeleton and that presents the gripping surface.

Also provided is a method of making a putter. A putter is provided that includes a head having a heel, a toe, and a striking face. The putter also includes a putter shaft having a lower end attached to the head and having an upper end. An elongated tubular grip having an upper end, a lower end, an outer peripheral gripping surface, and a bore extending from the lower end toward the upper end is also provided. The bore is dimensioned and configured to permit the grip to be mounted on an end of a putter shaft. The gripping surface includes a first, semi-cylindrical surface portion and a second, at least generally flat surface portion. The upper end of the shaft is inserted into the bore in the grip. The grip is orientated with the flat surface portion in a desired orientation relative to the striking face of the putter head. A plurality fasteners are tightened on the grip against an outer surface of the shaft to affix the grip to the shaft. The fasteners are accessible from the gripping surface of the grip.

An effective length of the shaft can be set prior to mounting the grip on the shaft. Preferably, the effective length is set by mounting an extender on top of the shaft to form an extended shaft and inserting the extended shaft into the bore until an upper end of the extended shaft contacts a bottom inside surface of the grip.

Other features and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

1. Resume

Pursuant to a preferred embodiment of the invention, a putter grip is provided which has a generally cylindrical body extending from a lower end to an upper end. The body is overly wide compared to conventional putter grips, and has little or no taper so as to form a step between the lower end of the grip and the shaft that. The step is suitable for receiving a user's index and middle fingers on opposite sides of the shaft to help ensure that the golf club will not twist or turn during a putting stroke and thus enhance the ability of the golfer to strike the ball squarely and to drive it along the intended line of travel. The cylindrical body may have a portion cut away so as to produce an elongated flat surface extending from the lower end of the grip to the upper end. The flat surface may be configured to further stabilize the club during the putting stroke. Optional spacers or a shaft extender can be inserted between an upper end of the shaft and a ceiling of the bore of the grip to set a spacing between the upper end of the shaft and the ceiling bore.

2. Construction and Operation of a First Preferred Embodiment

Figure 1:
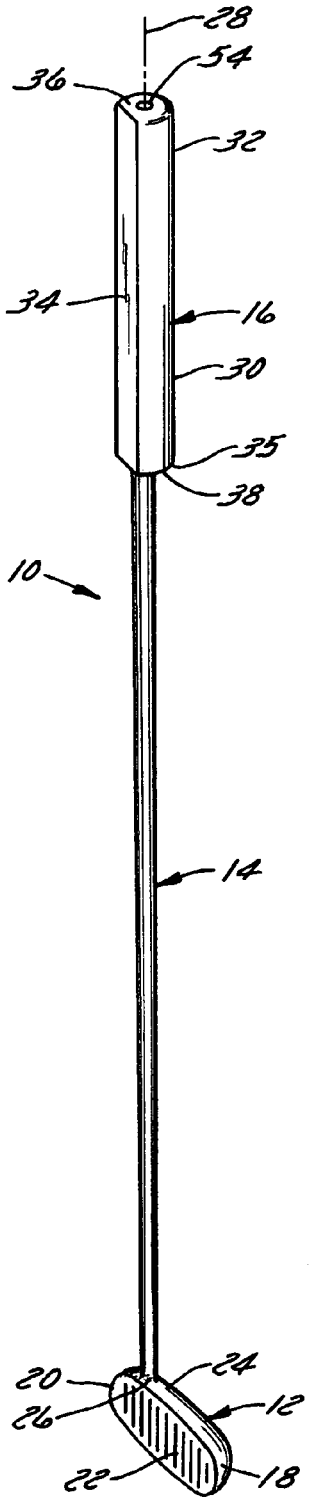
FIG. 1 is a perspective view of a putter incorporating a grip constructed in accordance with a first preferred embodiment of the present invention.
Figure 3:
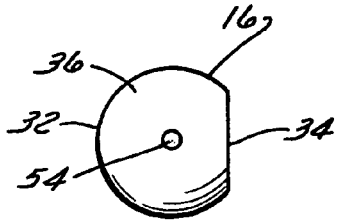
FIG. 3 is a top plan view of the grip of FIG. 1.
Figure 2:
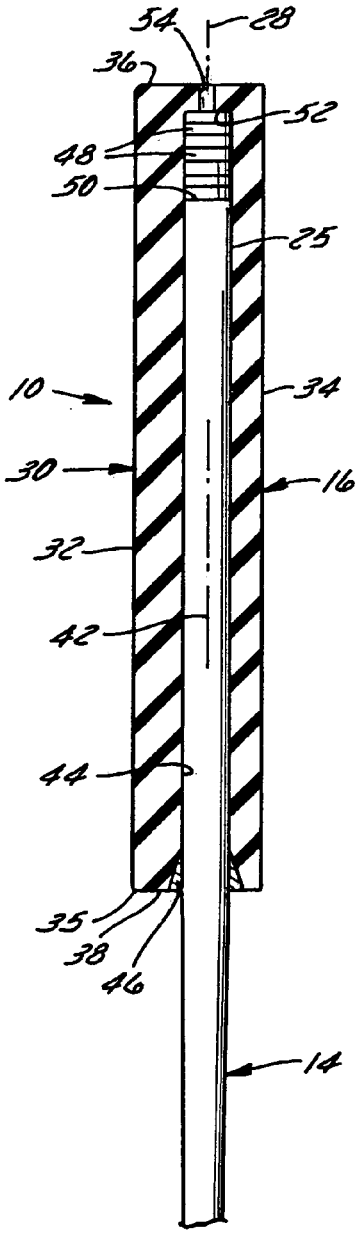
FIG. 2 is a sectional side elevation view of the grip of FIG. 1.

Referring now to FIGS. 1–3, a putter 10 is illustrated which is conventional in construction except for incorporating a grip constructed in accordance with a preferred embodiment of the invention. The putter 10 thus includes a head 12, a shaft 14, and a grip 16.

The head 12 may be any commercially available putter head formed from aluminum, brass, or any other material commonly used in putter heads. As is conventional, the head includes a front toe 18, a rear heel 20, a flat striking face 22 designed to engage the ball, and a top surface 24.

The shaft 14 is also conventional and may be formed from a steel tube as illustrated or from graphite or any other material commonly used in shafts. The shaft 14 has an upper end 25 which is covered by the grip 16 and a lower end 26 which is attached to the top 24 of the head 12. The shaft 14 is generally cylindrical and, therefore, has a longitudinal axis 28.

A first preferred embodiment of the grip 16 includes an elongated tubular molded body 30 whose outer periphery consists of a first wall or surface 32 that is partially cylindrical in shape and a second wall or surface 34 that is generally flat. The body may be molded from a single material such as natural rubber, silicon rubber, plastic, or any other material commonly used in putter grips. The body 30 has an upper end 36 which is fully or partially closed either by an end portion molded integrally with the remainder of the body or by a cap or plug capable of fitting onto or into the upper end of the shaft 14. The body 30 further includes a lower end 38 which is open so as to be capable of sliding over the shaft 14. Preferably, the top end 36 of the grip 16 has a hole 54 to permit air to escape as the grip 16 is mounted on the shaft 14. An axial bore 44 is created within the grip 16 and is aligned with a longitudinal axis 42 of the grip 16. The diameter of the bore closely matches the diameter of the shaft so that the grip 16 tightly surrounds the shaft 14 when the shaft is inserted into the grip 16.

The grip 16 is constructed such that the maximum diameter of the grip formed by walls 32 and 40 is approximately 1⅝ to 1¾ inches maximum, with 1 11/16 inches preferred. This overall larger grip decreases flexing of the user's wrists during use. The grip 16 also has little or no taper so that its minimum diameter is at least 1½". As a result, when the grip 16 is mounted onto the ⅜" diameter shaft 14, a step 35 of considerable width is formed between the lower end 38 of the grip and the shaft 14. The step typically will be on the order ¼" to ⅝".

When the grip 16 is made of a material with relevant low resilience and/or the shaft 14 has a substantial taper such that the inner perimeter of the grip 16 will not form a tight seal with the outer perimeter of the shaft 14, one or more tapered wedges 46 can be inserted in the gap between the grip 16 and the shaft 14. This gap typically will be on the order 1/16" to 1/8" thick. The wedge(s) may be made from rubber, a polymeric material, or the like. Alternatively, the gap may be filled with an adhesive resin or the like to secure the grip 16 to the shaft 14.

Optionally, one or more spacers 48 may be inserted between an upper end 50 of the upper end 25 of the shaft 14 and a ceiling 52 of the bore 44 in the grip 16. The optional spacer(s) determine(s) the amount of overlap of the grip 16 onto the shaft 14 by setting a spacing between the upper end 50 of the shaft 14 and the ceiling 52 of the bore 44. This permits the position of the grip 16 relative to the shaft 14 to be adjusted by varying the number and/or thickness of the spacers 48, hence varying the putter's grip height.

It is contemplated that the user will engage the flat wall 34 with the palm of his or her forward hand and will engage the step 35 with his or her two fingers of the trailing hand on opposite sides of the shaft. The flat wall 34 therefore is aligned generally parallel with the flat striking space 22. The user's trailing hand then will engage the grip 16 generally around the partially cylindrical wall 32. Thus, the embodiment shown in FIG. 1 is designed for a left-handed golfer. The grip 16 could just as easily be configured for a right-handed golfer by mounting the grip onto the shaft 14 rotatably offset 180 degrees from the illustrated embodiment. However, the flat portion could be anywhere (i.e., the user can put it on any side the user wants).

In use, when a golfer is preparing to put, he or she aligns the clubface 22 of the putter 10 with the ball in the conventional manner. Assuming the golfer is a left handed golfer, he or she then grasps the grip 16 with the left hand in the conventional manner and with the right hand in a manner which is for the most part conventional. However, rather than overlapping the index finger of the golfer's right hand over the left hand, the golfer engages the step 35 of the grip 16 with his or her two fingers of the left hand on opposite sides of the shaft. Additionally, the golfer's wrist of his or her right hand will engage the flat wall 34. Gripping the club 10 in this manner has been found to inhibit or prevent the golfer from twisting or turning the club face in or out during the putting stroke, thereby greatly enhancing the golfer's ability to drive the ball along its intended travel path. It is believed that the geometry of the grip 16 achieves this result much more efficiently than grooves, furrows, or other irregularities in the surface of grips designed to improve a golfers hold on the grip. Moreover, unlike grooves, etcetera, and except for providing a new point of engagement for one of the golfer's fingers, the golfer is free to grasp the grip 16 in any way he or she desires with comfort and without interference from the surface of the grip 16. Furthermore, engaging the flat wall 34 of the grip 16 with the golfer's wrist of his or her right hand keeps the backside of the right hand square to the target, further enhancing the golfers ability to drive the ball along its intended travel path.

While the grip 16 includes both the cylindrical wall 32 and the flat wall 34, it could also be completely cylindrical. In this modification, the golfer's grip would be conventional except that the index and middle fingers of his or her trailing hand would engage the step 35 on opposite sides of the shaft.

3. Construction and Operation of a Second Preferred Embodiment

Although the grip 16 discussed above is preferred because it can be formed in a single molding step, it may be desirable to provide a grip made of two components. A grip made of two components, although more difficult to manufacture and more expensive than a grip made in a single molding step, may be advantageous to some because molding a rubber as thick as is required by the first preferred embodiment may be difficult.

Figure 4:
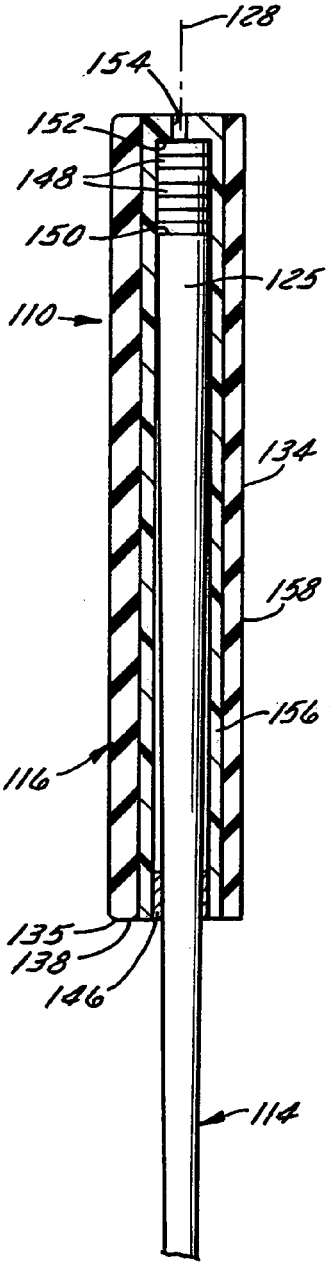
FIG. 4 is a sectional side elevation view of a grip constructed in accordance with a second preferred embodiment of the present invention.

Toward this end, referring to FIG. 4, a two-component grip 116 is illustrated for a putter 110 that is identical to the putter 10 of the first embodiment except that it incorporates two materials into the grip 116. Elements of the putter 110 of FIG. 4 corresponding to elements of the putter 10 of FIGS. 1–3 are, accordingly, designated by the same reference numerals, incremented by 100. The club 110 thus includes a head (not shown), a shaft 114, and a grip 116. A bore 144 in the grip 116 slips over the end of the shaft 114 to fix the grip in place. Also as in the first embodiment, a wedge 146 may be inserted in the gap between the bottom end of the grip 116 and the shaft 114 to help secure the grip 116 to the shaft 114. Spacers 148 may be inserted between the top 150 of the upper end 125 of the shaft 114 and the ceiling 152 of the bore 144 in the grip 116 to set the grip height of the grip 116.

The grip 116 differs from the grip 16 of the first embodiment only in that it is made of two components, a relatively rigid inner plastic sleeve 156 and a relatively pliant outer grip portion 158. The inner plastic sleeve 156 is preferably a high density polyethylene or a polypropylene. The two components grip 116 could be molded in a bi-material co-extrusion process. Alternatively, the two component grip 116 may be manufactured in separate steps, and the outer grip portion 158 may be slipped over and glued onto or otherwise affixed to the inner sleeve 156.

4. Construction and Operation of a Third Preferred Embodiment

Although the grips 16 and 116 discussed above are beneficial because the position of the grip can be set in a desired position, it may be desirable to provide a grip in which the position can be permanently set in a desired position.

Toward this end, referring to FIGS. 5–13, a grip 216 is provided for a putter 210 that is at least generally identical in size and shape to the putter 10 of the first embodiment. Hence the outer periphery of the grip 216 consists of a first surface 232 that is partially cylindrical in shape and a second surface 234 that is at least generally flat. The maximum diameter of the grip 216 formed by walls 32 and 40 is approximately 1 5/8 to 1 3/4 inches maximum, with 1 11/16 inches preferred. This overall larger grip decreases flexing of the user's wrists during use. The grip 216 also has little or no taper so that its minimum diameter is at least 1 1/2". As a result, when the grip 16 is mounted onto the 3/8" diameter shaft 14, a step 35 of considerable width is formed between the lower end 38 of the grip and the shaft 14. The step typically will be on the order 1/4" to 5/8".

Figure 5:
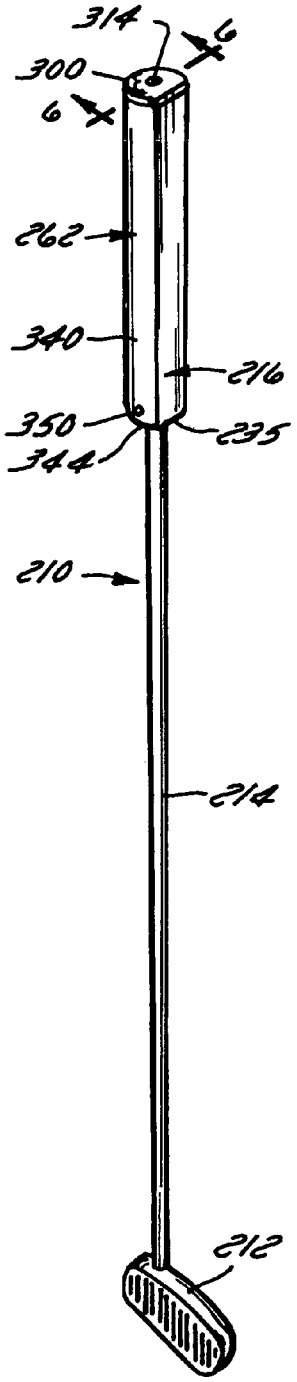
FIG. 5 is a perspective view of a putter incorporating a grip constructed in accordance with a third preferred embodiment of the present invention.

The grip 216 differs from the grips 16 and 116 primarily in that it can be securely but removably fixed in a desired position on the shaft 214 using selectively tightenable fasteners and without using the wedges of the first embodiment. Putter 210 also differs from putter 10 in that the molded body 230 is formed from a two-piece skeleton 260 and an outer gripping portion or sleeve 262 that covers the skeleton 260 and that preferably is formed form an elastomeric material. Elements of the putter 210 of FIGS. 5 and 13 corresponding to elements of the putter 10 of FIGS. 1–3 are, accordingly, designated by the same reference numerals, incremented by 200. As is shown in FIG. 5, the putter 210 thus includes a head 212, a shaft 214, and a grip 216.

Figure 6:
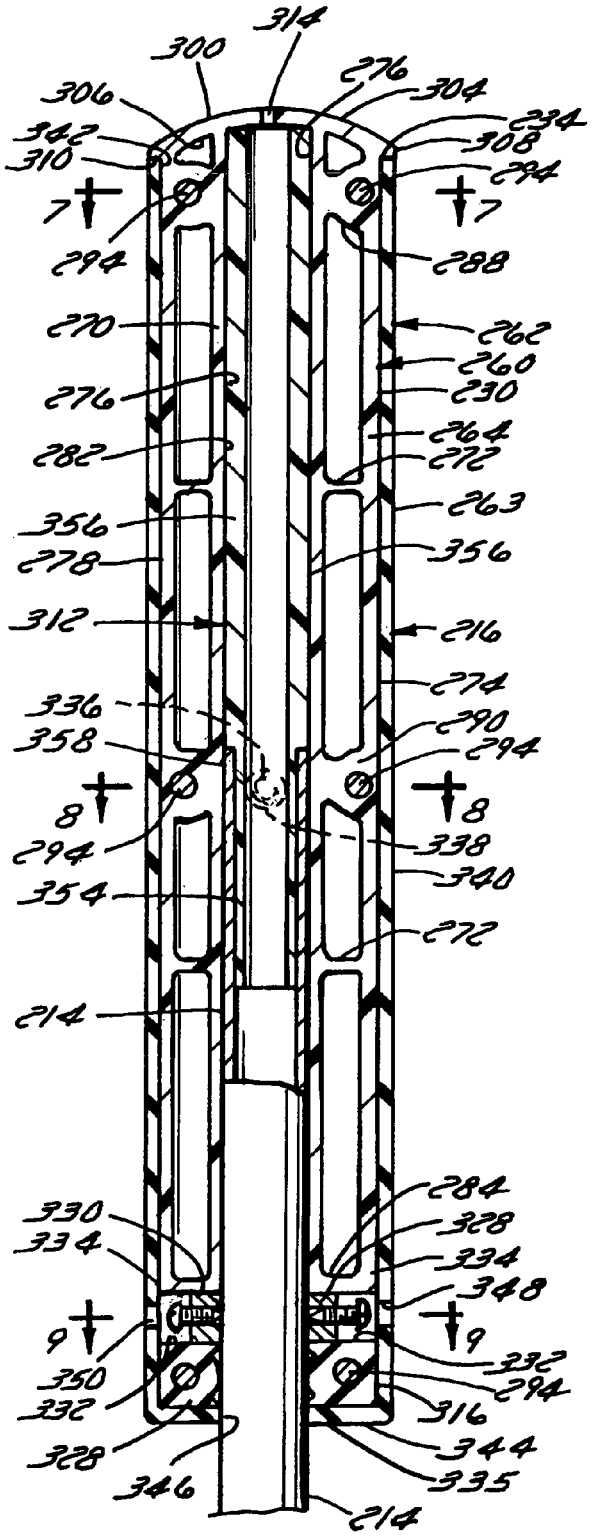
FIG. 6 is a sectional side elevation view of the grip through line 6—6 of FIG. 5.
Figure 7:
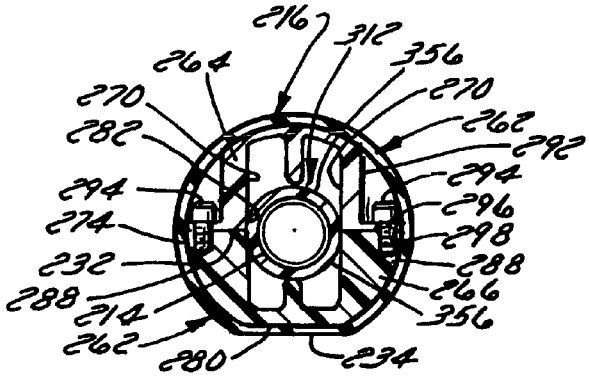
FIG. 7 is a sectional top plan view of the grip through line 7—7 of FIG. 6.
Figure 8:
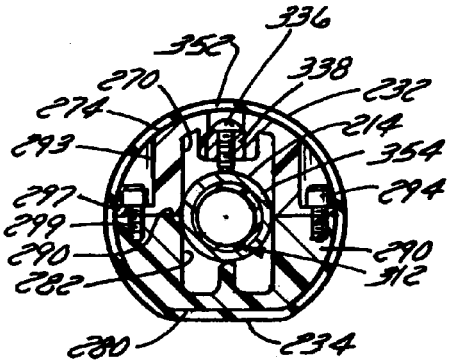
FIG. 8 is a sectional top plan view of the grip through line 8—8 of FIG. 6.

Referring now FIGS. 6–11, and 13 the elongated skeleton 260 has a first portion 264 and a second portion 266 screwed or otherwise attached to one another to form a single tubular skeleton. The first and second portions 264 and 266 of the skeleton 260 preferably are of identical construction. Preferably, each portion 264 and 266 is formed from injection molded plastic, although other materials can be used. Each portion includes an outer section 268 and an inner section 270 attached to one another by a plurality of radial ribs 272 extending between the inner and outer sections 270 and 268. The outer sections 268 and the inner sections 270 of the respective first and second portions 264 and 266 face one another upon assembly of the skeleton 260 such that, when the first and second portions 264 and 266 are attached to one another, the outer sections 268 mate to form an outer wall 274 of the skeleton 260 and the inner sections 270 mate to form an inner wall 276. The outer surface of the outer wall 274 defines a support surface for the sleeve 262 and has a shape identical to that of the sleeve 262, i.e., it has a first, semi-cylindrical surface portion 278 and a second surface portion 280 that is at least generally flat. In the illustrated embodiment, the flat portion 280 is on the second portion 266 of the grip 216. The inner surface of the inner wall 276 defines a bore 282. Annular supports 284, spaced axially along the bore 282 and formed from mating arcuate ribs 284 extending inwardly from the inner wall 276, are configured to surround and engage the outer periphery of the grip 216 after assembly as best seen in FIGS. 7 and 8. Three such supports 284 are provided in the illustrated embodiment, spaced unequally along the length of the skeleton 260.

Each skeleton portion 264 and 266 also includes upper and central braces 288 and 290 that extend between the inner and outer sections 270 and 268 so as to matingly engage each other upon grip assembly as seen in FIGS. 7 and 8, respectively. The braces 288 and 290 in the first portion 264 are aligned with corresponding recesses 292 and 293 in the outer section 268 of the flat portion 280. At least two such recesses 292 and 293 are spaced peripherally around the outer periphery of the flat portion 280. An Allen screw 294 or the like is adapted to be inserted through each recess 292 and 293 in the outer section 268 of the first portion 264, through a through-bore 296 and 297 in the corresponding brace 288 and 290, and into a mating tapped bore 298 and 299 in the corresponding brace 288 or 290 of the second skeleton portion 266, thereby rigidly attaching the first and second skeleton portions 264 and 266 to one another. This configuration permits the heads of the Allen screws 294 to be fully recessed within the skeleton 260, thereby preventing the Allen screws 294 from interfering with subsequent sleeve attachment or grip use.

A cap 300 is formed at the upper end 302 of the skeleton 260 from mating sections of the first and second skeleton portions 264 and 266. The cap 300 is convex in shape, having an upper surface 304, a bottom surface 306, and an outer peripheral surface 308. The outer peripheral surface 308 has a shape that complements that of the outer surface of the grip 216 (i.e., it has a semi-cylindrical surface portion and a flat surface portion). The outer peripheral surface 308 has a diameter that is slightly larger than that of the outer surface 278, 280 of the skeleton 260 so as to present a lower step or shoulder 310 against which the sleeve 262 engages upon grip assembly. The bottom surface 306 of the cap 300 acts as an abutment surface for the top of the shaft 214 or a shaft extender 312 (should the user wish to employ an extender as described below). A hole 314 is formed axially through in the center of the cap 300 for permitting air to escape while mounting the grip 216 on the shaft 214.

Figure 11:
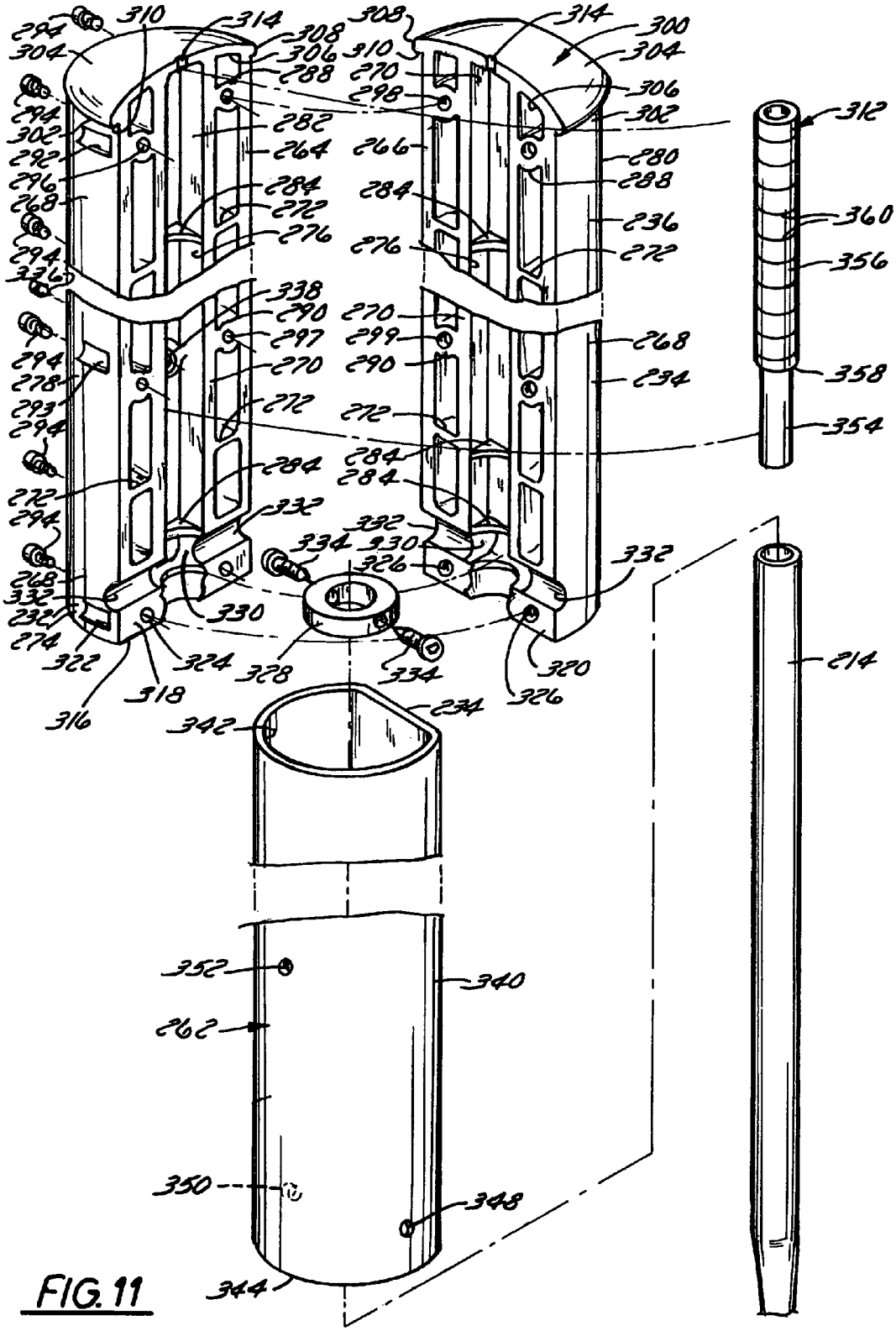
FIG. 11 is an exploded view of the grip of FIG. 5, a shaft extender, and an upper end of the shaft.

The bottom of the skeleton 260 is formed from a segmented ring 316 having first and second sections 318 and 320 formed on the respective first and second portions 264 and 266 of the skeleton 260. As best seen in FIGS. 6 and 11, the first ring section 318 has spaced indented recesses 322 aligned with corresponding through-bores 324 formed therein. As with the upper and central braces 288 and 290, an Allen screw 294 or the like is adapted to be inserted through each recess in the of the first section 318, through the corresponding through-bore 324, and into a mating tapped bore 326 in the second section 320 of the ring 316 to hold the first and second skeleton portions 264 and 266 together.

Figure 10:
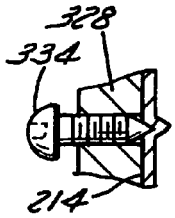
FIG. 10 is a sectional side elevation view of a setscrew that is used to attach the grip of FIG. 5 to a shaft.
Figure 9:
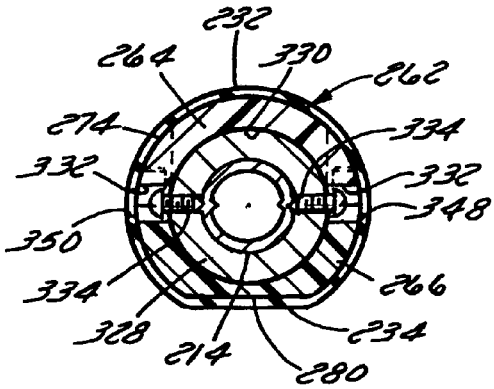
FIG. 9 is a sectional top plan view of the grip through line 9—9 of FIG. 6.

Still referring to FIG. 11, the grip 216 further includes an annular collar 328 that is clamped in a groove 330 in the segmented ring 316 upon skeleton 260 assembly. An inner peripheral surface of the collar 328 is dimensioned such that the shaft 214 of the putter 210 can fit therethrough. Grooves 332 in the mating ring sections 318 and 320 (FIG. 11) form opposed recesses 332 in the assembled ring 316 that provide access to setscrews 334 that extend through the collar 328 as best seen in FIG. 9. These setscrews 334 preferably comprise button-head Allen setscrews. The recesses 332 and corresponding setscrews 334 preferably are spaced approximately 90° in opposite directions from the flat surface 234 of the grip 216. As is illustrated in FIGS. 6 and 9, the setscrews 334 facilitate initial positioning of the grip 216 on the shaft 214 in any desired orientation and can be tightened to lock the grip 216 to the shaft 214. Preferably, the setscrews 334 have pointed tips or are otherwise configured to at least dimple the shaft 214 as best seen in FIG. 10 so as to form more than just a friction fit against it. This dimpling provides a secure attachment that effectively prevents adjustment of grip 216 orientation during a round of golf. More preferably, the setscrews 334 puncture the shaft 214 to some extent, but not so much as to ruin the integrity of the setscrew 334 to shaft 214 attachment.

In addition, a third button-head setscrew 336, accessible through another recess 352 in the grip 216, is threaded through a tapped insert 338 mounted in the skeleton 260 approximately one-quarter way up the grip 216 and spaced 180° spaced from the flat surface portion 234 of the grip 216 as best seen in FIG. 8. The third setscrew 336 is identical to the aforementioned setscrews 334 and is configured to engage the shaft 214 in the identical manner as the aforementioned setscrews 334, further enhancing the integrity of the grip 216 to shaft 214 attachment.

The outer gripping portion 262 of the grip 216 comprises a tubular sleeve 262 that is blow-mounted over the skeleton 260 using conventional blow-mounting. This blow-mounting provides a very secure, permanent friction fit that prevents relative movement of the outer gripping portion 262 relative to the skeleton 260 after mounting. The sleeve 262 has a tubular outer periphery 340, an open upper end 342, and a lower end 344 having a central opening 346 for receiving the shaft 214. The upper end 342 abuts the shoulder 310 on the cap 300 after the sleeve 262 is blow-mounted on the skeleton 260. The lower end 344 forms the bottom of the grip 216. The outer periphery 340 forms the gripping surface of the grip 216 and presents the aforementioned semi-cylindrical surface 232 and generally flat surface portion 234. First, second, and third openings 348, 350, and 352 are formed through the outer peripheral surface 340 of the sleeve 262 in alignment with the corresponding recesses in the skeleton 260 in order to provide access to the Allen setscrews 334 and 336 after the grip 216 is fully assembled.

The grip 216 as described above is assembled by placing the collar 328 between the skeleton portions 264 and 266, aligning the skeleton portions 264 and 266 with one another, and attaching the skeleton portions 264 and 266 to one another using the Allen screws 294. The sleeve 262 is then blow-mounted over the skeleton 260 from below to complete the assembly process. All of these operations may be performed at the factory.

After assembly, the grip 216 is simply slipped over the end of the shaft 214 from above and inserted fully onto the shaft 214 until the end of the shaft 214 (or the shaft extender 312, if provided) contacts the bottom inside surface 306 of the cap 300. The flat portion 234 of the outer surface of the grip 216 may be oriented in any desired direction relative to the club head 212, including parallel with the striking face, parallel with the rear surface, parallel with the nose, or parallel with the toe. The grip 216 is then secured in place by tightening the setscrews 334 and 336 until they at least dimple, and preferably pierce, the shaft 214. The grip 216 can subsequently be repositioned between rounds but, because of the tight mounting of the setscrews 334 and 336, is not designed to be repositioned during a round.

The assembled grip 216 has all of the benefits discussed above in connection with the first and second embodiments. All three embodiments have the additional benefit of tending to reduce the pressure applied to the grip during a putting stroke. This leads to a much looser grip, which leads to an improved stroke by any user but particularly for those who have stiff fingers, and particularly those with arthritis. Studies have shown that the oversized grip reduces the pressure by about 40 percent.

Figure 12:
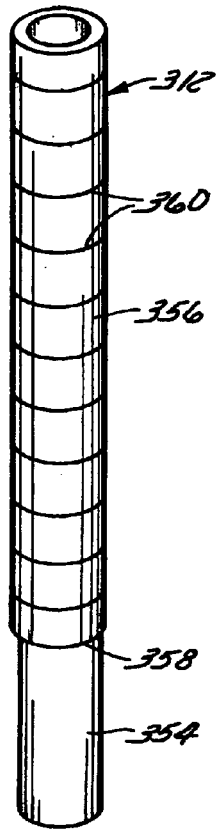
FIG. 12 is a perspective view of a shaft extender of that can be used in combination with the grip of FIG. 5.

The spacers 48 of the previous embodiment may be employed with the grip 216 of this embodiment in order to set the amount of overlap of the grip 216 onto the shaft 214 by setting a spacing between the upper end of the shaft 214 and the ceiling of the grip's bore 282. As indicated above, setting the shaft-to-grip end spacing in this manner permits the height of the grip 216 relative to the putter head 212 to be adjusted, hence altering the effective length of the shaft 214 and the putter grip's height. The same effect may be achieved using a single, stepped shaft extender or spacer tube 312. One such tube is shown in FIGS. 6, 11, and 12. The tube 312 comprises a stepped plastic tube 312 having a relatively small diameter lower portion 354 and a relatively large diameter upper portion 356 joined to the lower portion 354 at a step 358. The step 358 forms a support surface for supporting the tube 312 on the upper end of the shaft 214. The diameter of the lower portion 354 closely matches the diameter of the bore 282 in the shaft 214 so as to permit the lower portion 354 to be snugly inserted into the bore 282. The diameter of the upper portion 356 is greater than that of the bore in the shaft 214 but not significantly larger than the outer diameter of the shaft 214 in order to permit the bore 282 in the skeleton 260 to fit over it. In a preferred embodiment, the diameter of the upper portion 356 of the tube 312 is about 1.60 inches and the diameter of the lower portion 354 is about 1.55 inches.

The lower portion 354 of the tube 312 should be sufficiently long to provide a secure, stable fit within the shaft 214. Preferably, the length of the lower portion 354 of the tube 312 is between 1 and 3 inches and most preferably about 1¾ inches. The upper portion 356 of the tube 312 has a maximum length that corresponds to the maximum desired extension of the shaft 214. Maximum lengths of 2 inches to 6 inches or more are feasible. The currently preferred maximum length is 5 inches. As best seen in FIG. 12, graduations 360 are spaced equally along the upper portion 356 at increments corresponding to desired height adjustment increments, preferably ¼ inch. The graduations 360 preferably take the form of score lines 360 to facilitate cutting of the tube 312 in a desired location, hence facilitating tube 312 height selection.

Figure 13:
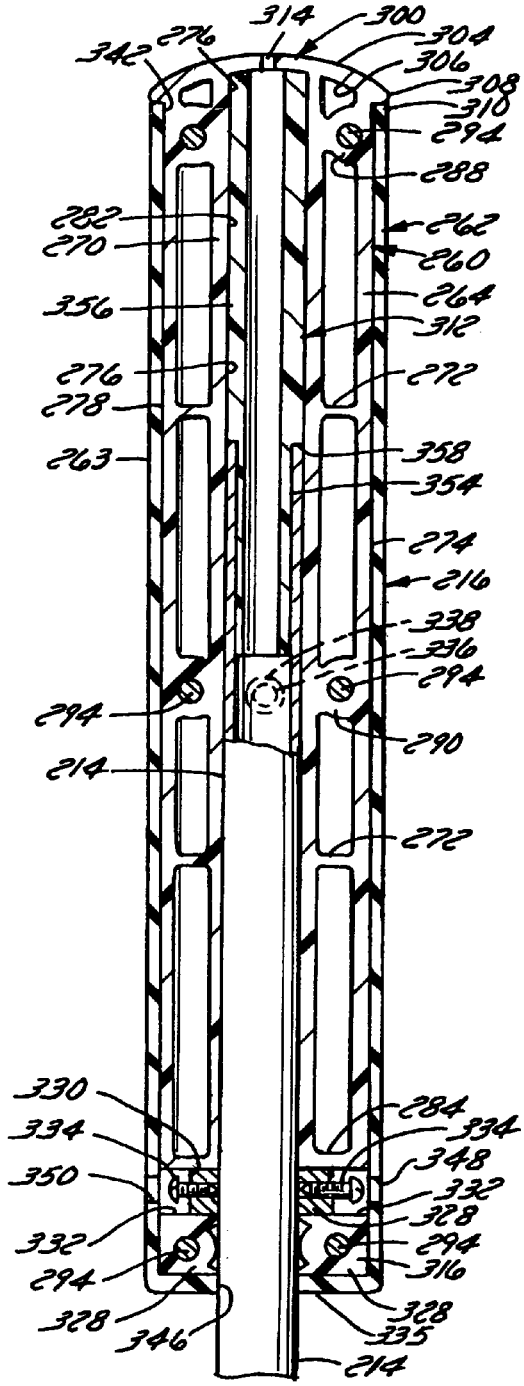
FIG. 13 is a sectional side elevation view corresponding to FIG. 6 but showing an alternative configuration of the shaft extender.

The user can set the effective height of the grip 216 by cutting the tube 312 along the desired graduation 360, and inserting the lower portion 354 of the tube 312 into the shaft 214 until the step 358 rests on top of the shaft 214. A comparison of FIGS. 6 and 11 reveals that the effective height of the shaft 214 can be altered significantly if one chooses to cut the tube 312 along one of the lower graduations 360 to form a short extension as seen in FIG. 6 or chooses to cut the tube 312 along one of the higher graduations 360 (or not cut it at all) to form a long extension as seen in FIG. 13. Of course, the user need not use the tube 312 or the corresponding spacers 48 of the prior embodiments at all. The grip 216 could simply be slipped over and mounted directly on the shaft 214.

Once the user cuts the tube 312 to the desired length, he or she then fixes the tube 312 in place, preferably using both glue and tape to prevent the tube 312 from shifting or being removed from the shaft 214. The grip 216 then slips over the tube 312 and is pushed down over the tube 312 and shaft 214 until the top of the tube 312 abuts the inner surface 306 of the cap 300 of the grip 216. The grip 216 is then secured to the shaft 214 using the Allen setscrews 334 and 336 as described above.

As with the other preferred embodiments of the putter, with this preferred embodiment of the putter 210, rather than overlapping the index finger of the golfer's right hand over the left hand, the golfer engages the step 235 of the grip 216 with his or her two fingers of the left hand on opposite sides of the shaft 214.

5. Construction and Operation of a Fourth Preferred Embodiment

Figure 14:
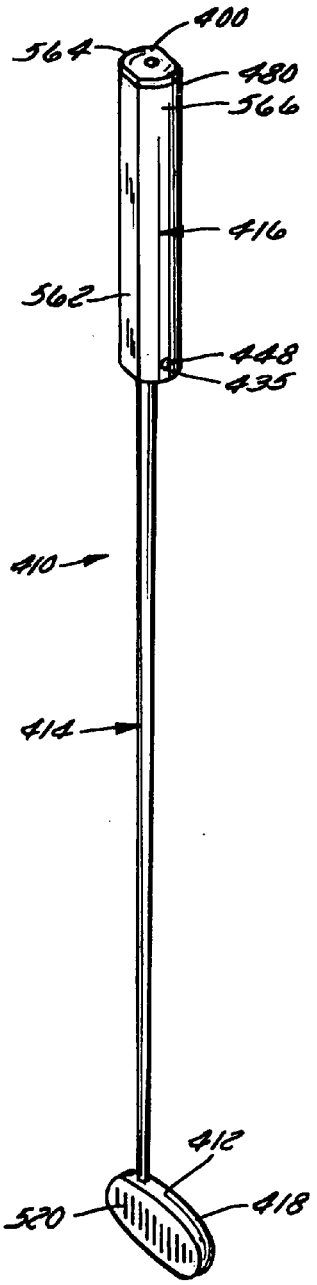
FIG. 14 is a perspective view of a putter incorporating a grip constructed in accordance with a fourth preferred embodiment of the present invention.

A fourth preferred embodiment of a grip 416 is illustrated in FIG. 14 that is identical to the putter 210 of the third embodiment except that its outer periphery surface has a slightly different shape, having a first generally flat surface portion 562 and a second generally flat surface portion 434 that are of equal length and spaced 180 degrees from each other. The first and second flat surface portions 562 and 434 are linked by first and second arcuate surface portions 564 and 566, each preferably taking the form of a partial cylinder. Elements of the putter 410 of FIG. 14 corresponding to elements of the putter 210 of FIGS. 5–13 are, accordingly, designated by the same reference numerals, incremented by 200. The putter 410 thus includes a head 412, a shaft 414, and a grip 416, as is shown in FIG. 14. The generally flat first surface portion 562 aligned with the striking face 520 of the putter 410 and the generally flat second surface portion 434 is aligned with the rear surface 418 of the putter. This particular orientation is believed to be especially effective at stabilizing the putting stroke.

Of course, many modifications could be made to the invention as described an illustrated without departing from the spirit of the present invention. The scope of such changes will become apparent from the appended claims.

I claim:

1. A putter grip comprising:

(A) an elongated body of generally uniform diameter along an axial length thereof comprising a skeleton having a first portion and a second portion, each of the first and second portion including:

(1) an upper end, (2) a lower end opposite the upper end, and (3) a bore disposed within said lower end and extending upwardly so as to be configured to receive a shaft of a putter;

(B) an outer gripping sleeve that fits over the skeleton and that has an outer peripheral surface including a first surface portion that is partially cylindrical in shape and a second surface portion that is at least generally flatlands that is continuous with the first surface portion; and (C) an annular collar that includes two opposed through bores and an inner surface that is configured and dimensioned to receive the shaft of the putter;

wherein the grip is configured to form a step with the shaft, the step being dimensioned and configured to receive two fingers of a golfer on opposite sides of the shaft, wherein said grip is configured and dimensioned to be removably affixed to the shaft by fasteners, wherein said first portion and said second portion of the skeleton are held together by a system of fasteners that go through bores in said first portion of said skeleton and into said second portion to hold the two skeleton portions together, and wherein each of the skeleton portion includes first and second recesses that permit access to the fasteners from the exterior of the grip.

2. The putter grip of claim 1, wherein the recesses are preferably located approximately 90° form the generally flat second surface portion of the grip.

3. A putter grip comprising:

(A) an elongated body of generally uniform diameter along an axial length thereof and comprising a skeleton having a first portion and a second portion, each of the first and second portions including:

(1) an upper end, (2) a lower end opposite the upper end, and (3) a bore disposed within said lower end and extending upwardly so as to be configured to receive a shaft of a putter; and (B) an outer gripping sleeve that fits over the skeleton and that has an outer peripheral surface including a first surface portion that is partially cylindrical in shape and a second surface portion that is at least generally flat and that is continuous with the first surface portion, wherein the grip is configured to form a step with the shaft, the step being dimensioned and configured to receive two fingers of a golfer on opposite sides of the shaft, and wherein said grip is configured and dimensioned to be removably affixed to the shaft by fasteners that extend at least generally radially through said grip and into engagement with the shaft, wherein the step is configured to be between ¼ inch and ⅝ inch thick.

4. The putter grip of claim 3, wherein the step is configured to be ⅝ inch thick.

5. The putter grip of claim 3, further comprising an extender tube that includes an upper portion that fills a gap between an upper end of the bore in the body and the shaft.

6. The putter grip of claim 5, wherein the extender tube includes a lower portion that is of reduced diameter when compared to the diameter of the upper portion and that fits inside the shaft, wherein the upper portion of the extender tube includes spaced graduations thereon.

7. The putter grip of claim 6, wherein the graduations are spaced equally along the upper portion.

8. The putter grip of claim 7, wherein the graduations are spaced at ¼ inch intervals.

9. A putter grip comprising:

(A) an elongated body of generally uniform diameter along an axial length thereof and comprising a skeleton having a first portion and a second portion, each of the first and second portions including:

(1) an tipper end, (2) a lower end opposite the upper end, and (3) a bore disposed within said lower end and extending upwardly so as to be configured to receive a shaft of a putter; and (B) an outer gripping sleeve that fits over the skeleton and that has an outer peripheral surface including a first surface portion that is partially cylindrical in shape and a second surface portion that is at least generally flat and that is continuous with the first surface portion, wherein the grip is configured to form a step with the shaft, the step being dimensioned and configured to receive two fingers of a golfer on opposite sides of the shaft, and wherein said grip is configured and dimensioned to be removably affixed to the shaft by fasteners that extend at least generally radially through said grip and into engagement with the shaft, wherein a maximum diameter of the grip is between 1⅝ inches and 1¾ inches.

10. The putter grip of claim 9, wherein the maximum diameter of the grip is about 1 11/16 inches.

11. A putter grip comprising:

(A) an elongated tubular grip having an upper end configured to be disposed above an upper end of a putter shaft, a lower end configured to surround the shaft, an outer peripheral gripping surface, and a bore extending from the lower end toward the upper end, the bore being dimensioned and configured to permit the grip to be mounted on the shaft such that the upper end of the grip is located beyond the upper end of the shaft and the lower end of the grip surrounds the shaft; and (B) a plurality of fasteners which extend through the gripping surface and into engagement with the shaft and which can be accessed from the gripping surface to tighten the fasteners into engagement with the shall to affix the grip to the shaft, wherein the grip 1) comprises a segmented skeleton including at least first and second portions that are fastened to one another by removable fasteners, and 2) a gripping portion that is mounted over the skeleton and that presents the gripping surface.

* * * * *